US009553380B2

(12) United States Patent
Fang et al.

(10) Patent No.: US 9,553,380 B2
(45) Date of Patent: Jan. 24, 2017

(54) CARD CONNECTOR

(71) Applicant: Tyco Electronics (Shanghai) Co. Ltd., Shanghai (CN)

(72) Inventors: Aihong Fang, Shanghai (CN); Simon Li, Shanghai (CN); Jianxin Wang, Shanghai (CN); Mao Lu, Shanghai (CN); Guoxiao Shen, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/667,923

(22) Filed: Mar. 25, 2015

(65) Prior Publication Data

US 2016/0093965 A1 Mar. 31, 2016

(30) Foreign Application Priority Data

Sep. 29, 2014 (CN) ..... 2014 1 0513120

(51) Int. Cl.

| | |
|---|---|
| ***H01R 12/00*** | (2006.01) |
| ***H01R 12/71*** | (2011.01) |
| ***H01R 13/24*** | (2006.01) |
| ***H01R 13/405*** | (2006.01) |

(52) U.S. Cl.

CPC ..... *H01R 12/714* (2013.01); *H01R 13/2407* (2013.01); *H01R 13/405* (2013.01)

(58) Field of Classification Search

CPC . H01R 12/714; H01R 13/405; H01R 13/2407; H01R 12/716; H01R 12/88

USPC ..... 439/81

See application file for complete search history.

(56) References Cited

U.S. PATENT DOCUMENTS

| | | | | |
|---|---|---|---|---|
| 5,013,264 A * | 5/1991 | Tondreault | ..... | H01R 12/82 439/636 |
| 5,679,018 A * | 10/1997 | Lopata | ..... | H01R 12/716 439/260 |
| 5,913,699 A * | 6/1999 | Zielke | ..... | H01R 12/88 439/267 |
| 6,012,928 A * | 1/2000 | Lopata | ..... | H01R 12/88 439/632 |

* cited by examiner

*Primary Examiner* — Jean F Duverne
(74) *Attorney, Agent, or Firm* — Barley Snyder

(57) ABSTRACT

A card connector is disclosed having a base and a plurality of contacts. The plurality of contacts is positioned on the base. Each of the contacts has a contacting portion electrically contacting an electrical card when the electrical card inserted into the card connector. Each contact has an outer facing surface, and a supporting portion having two elastic arms extending from the base and intersecting at the contacting portion. Each of the elastic arms has a guide arm portion extending from the contacting portion at an angle of approximately 0 to 90 degrees with respect to a card insertion direction. Each guide arm portions has a smooth, ridge-shaped convex surface extending to the contacting portion and a smooth transitional surface with the outer facing surface of the contacting portion.

22 Claims, 6 Drawing Sheets

CARD CONNECTOR

CROSS-REFERENCE TO RELATED APPLICATION

This application claims priority under 35 U.S.C. §119(a)-(d) or (f) to Chinese Patent Application No. 201410513120.1, filed on Sep. 29, 2014.

FIELD OF THE INVENTION

The invention is generally related to a card connector, and, more specifically, to a card connector having a plurality of contacts.

BACKGROUND

Conventionally, a card connector generally has a base and a plurality of cantilevered contacts fixed on the base. Each of the contacts has a contacting portion on a free end thereof.

The contacting portion contacts an electrical card inserted into the card connector to establish an electrical connection.

To prevent the contacts of the card connector from being damaged by the electrical card or a card tray during insertion of the electrical card, the electrical card is generally transversely inserted into the card connector, that is, the electrical card is inserted into the card connector in a direction angled to the contacts of the card connector. In this way, during inserting the electrical card, the electrical card or the card tray loaded with the electrical card firstly comes into contact with an outside guide of an elastic arm of the contact of the card connector. The electrical card or loaded tray then gradually presses the elastic arm downward, and moves the contacting portion of the contact under the guidance of the outside guide.

The conventional outside guide of the elastic arm of the contact has a sharp edge, and the sharp edge can scratch and even damage the electrical card.

Furthermore, the conventional outside guide of the elastic arm has the same width from the contacting portion to a fixed end of the elastic arm. The outside guide of the elastic arm protrudes toward a circuit board, on which the card connector is mounted. As a result, when the elastic arm is pressed downward, towards the circuit board, by the electrical card or the card tray during inserting the electrical card or the card tray, the outside guide can contact or the circuit board and can damage the circuit board or other electrical devices on the circuit board.

SUMMARY

A card connector has a base and a plurality of contacts. The plurality of contacts is positioned on the base. Each of the contacts has a contacting portion electrically contacting an electrical card when the electrical card inserted into the card connector. Each contact has an outer facing surface, and a supporting portion having two elastic arms extending from the base and intersecting at the contacting portion. Each of the elastic arms has a guide arm portion extending from the contacting portion at an angle of approximately 0 to 90 degrees with respect to a card insertion direction. Each guide arm portions has a smooth, ridge-shaped convex surface extending to the contacting portion and a smooth transitional surface with the outer facing surface of the contacting portion.

BRIEF DESCRIPTION OF THE DRAWINGS

The invention will now be described by way of example, with reference to the accompanying drawings, of which.

DETAILED DESCRIPTION OF THE EMBODIMENT(S)

Figure 1:
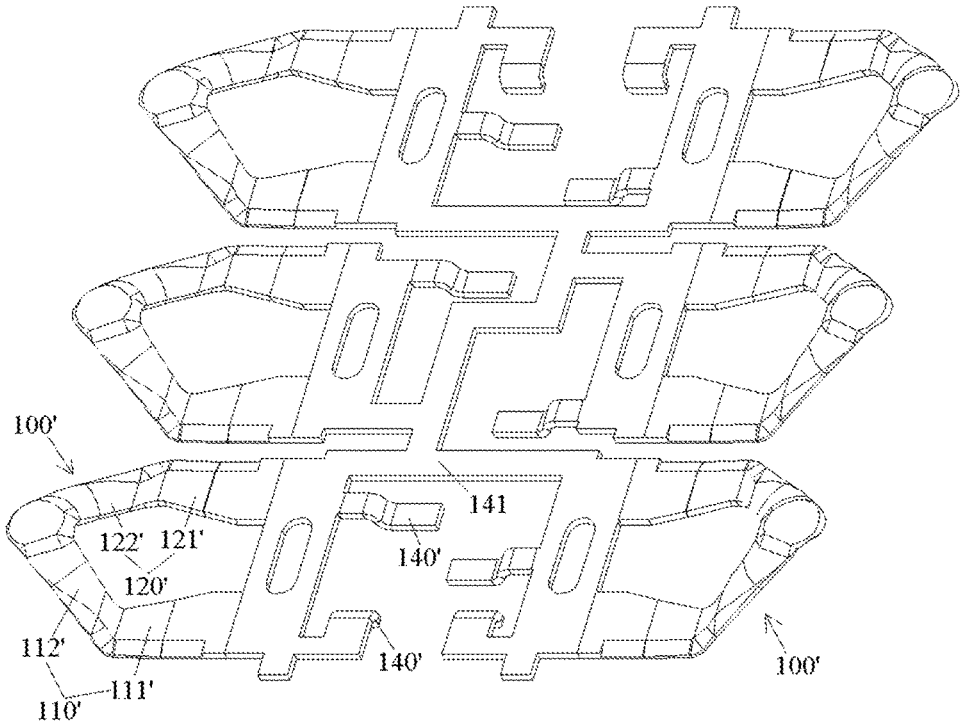
FIG. 1 is a perspective view of a plurality of contacts of a card connector.

The present invention has been made to overcome or alleviate at least one aspect of the above mentioned disadvantages.

Exemplary embodiments will be described hereinafter in detail with reference to the attached Figures, wherein the like reference numerals refer to the like elements. The disclosure may, however, be embodied in many different forms and should not be construed as being limited to the embodiment set forth herein. Therefore, these embodiments are provided so that the disclosure will be thorough and complete, and will fully convey the concept of the disclosure to those skilled in the art.

In the following detailed description, for purposes of explanation, numerous specific details are set forth in order to provide a thorough understanding of the embodiments. One of ordinary skill in the art would appreciate, however, that one or more embodiments may be practiced without these specific details. In some embodiments, well-known structures and devices are schematically shown in order to simplify the drawing.

In the embodiments shown in FIGS. 1-5, a card connector has a base 10, a plurality of contacts 100 and a shield 20.

Figure 2:
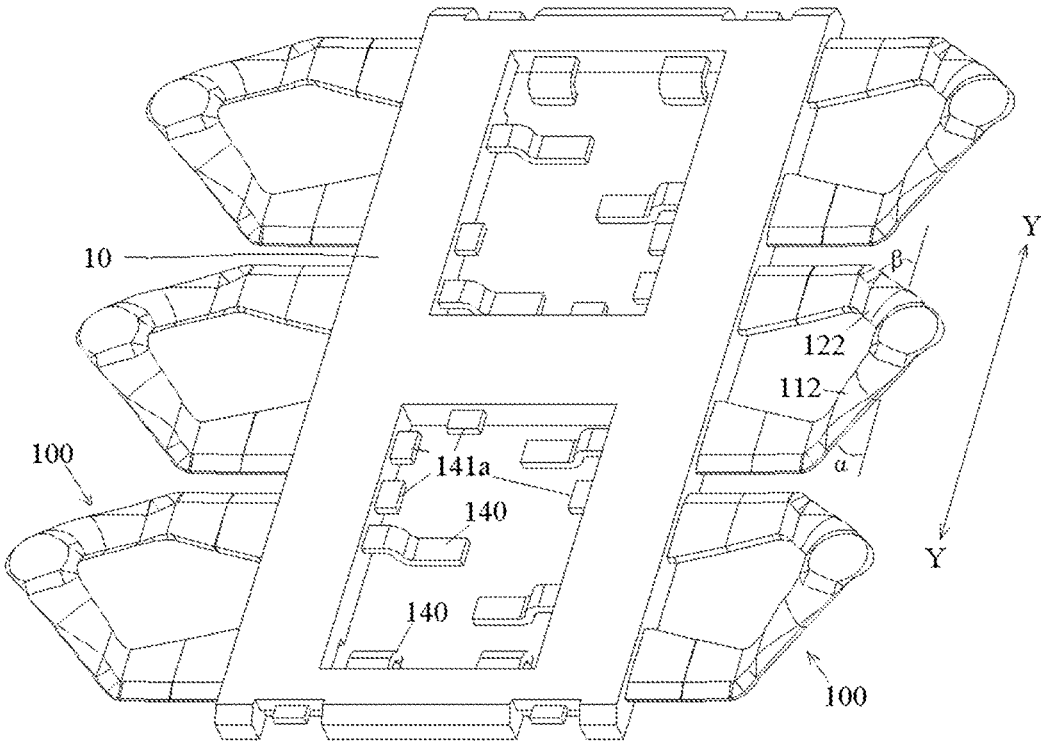
FIG. 2 is a perspective view of a first contact module of the plurality of contacts and an insulating base.

In an embodiment shown in FIG. 1, all the contacts 100 of the card connector may be made by processing a metal tape or a metal plate, such as through stamping or forming. The contacts 100 are connected to each other through connecting bridges 141. The base 10 is molded on these contacts 100. Therefore, the relative positions between the contacts 100 are maintained by the connecting bridges 141. After the base 10 has been molded on the contacts 100, the connecting bridges 141 are removed, electrically separating the contacts 100 from each other, as shown in FIG. 2. The cut-off ends 141*a* are left on these contacts 100 after cutting off these connecting bridges 141.

Figure 3:
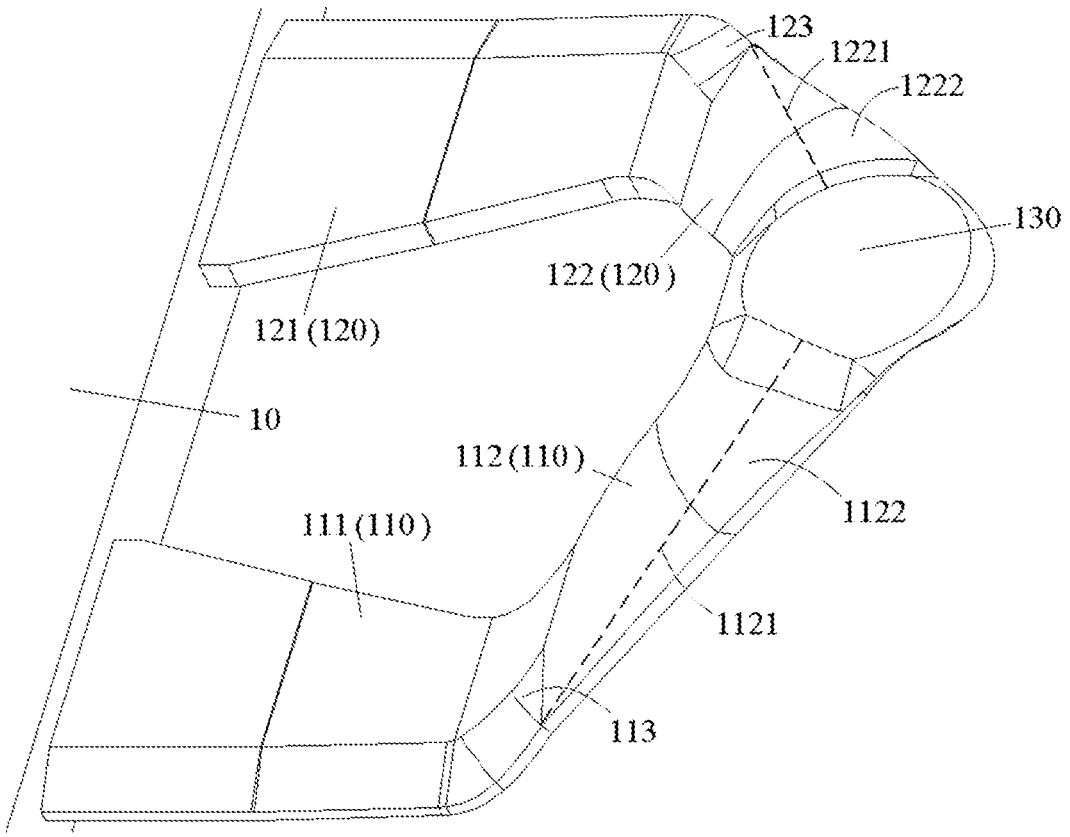
FIG. 3 is an enlarged perspective view of one of the contacts.

In the embodiments shown in FIGS. 1-3, in order to simplify the process, all contacts 100 are configured to be identical to each other. However, one of ordinary skill in the art would appreciate that in other embodiments, the contacts 100 may have different configurations.

Each contact 100 is cantilevered, having a fixed supporting portion and a contacting portion 130 formed on a free end. The contacting portion 130 electrical contacts an electrical card 30 inserted into the card connector. The supporting portion has a first elastic arm 110 and a second elastic arm 120 extending from the base 10 and intersecting at the contacting portion 130 to form the free end. For purposes of description clarity, in the embodiment shown in FIG. 1, the first elastic arm 110 is on an outward side, and the second elastic arm 120 is positioned on an inward side.

In the embodiments shown in FIGS. 1 and 2, the first elastic arm 110 has a first guide arm portion 112 extending to, and connecting to the contacting portion 130. The first elastic are 110 further includes a first fixed end arm portion 111 extending from the base 10 to the first guide portion 112, and connecting thereto. The first fixed end arm portion 111 will be discussed in more detail below. The first guide arm portion 112 defines an angle α larger than 0 degrees and less than 90 degrees with respect to a card insertion direction Y-Y (as shown in FIG. 2). The card insertion direction Y-Y is a direction in which the electrical card 30 is inserted into or removed out of the card connector. The first guide arm portion 112 is formed with a smooth, ridge-shaped, convex surface extending to the contacting portion 130, and the ridge-shaped convex surface forms a smooth transition with an outer facing surface of the contacting portion 130.

Similarly, the second elastic arm 120 has a second guide arm portion 122 extending to the contacting portion 130. The second elastic are 120 further includes a second fixed end arm portion 121 extending from the base 10 to the second guide portion 122, and connecting thereto. The second fixed end arm portion 121 will be discussed in more detail below. The second guide arm portion 122 defines an angle β larger than 0 degrees and less than 90 degrees with respect to the card insertion direction Y-Y. The second guide arm portion 122 is formed with a smooth, ridge-shaped, convex surface extending to the contacting portion 130, and the ridge-shaped, convex surface forms a smooth transition with an outer facing surface of the contacting portion 130.

In an embodiment, as shown in FIGS. 1-3, the two guide arm portions 112, 122 of each contact 100 are positioned at both sides of a plane perpendicular to the card insertion direction Y-Y and passing through the contacting portion 130 of the contact 100.

Figure 4:
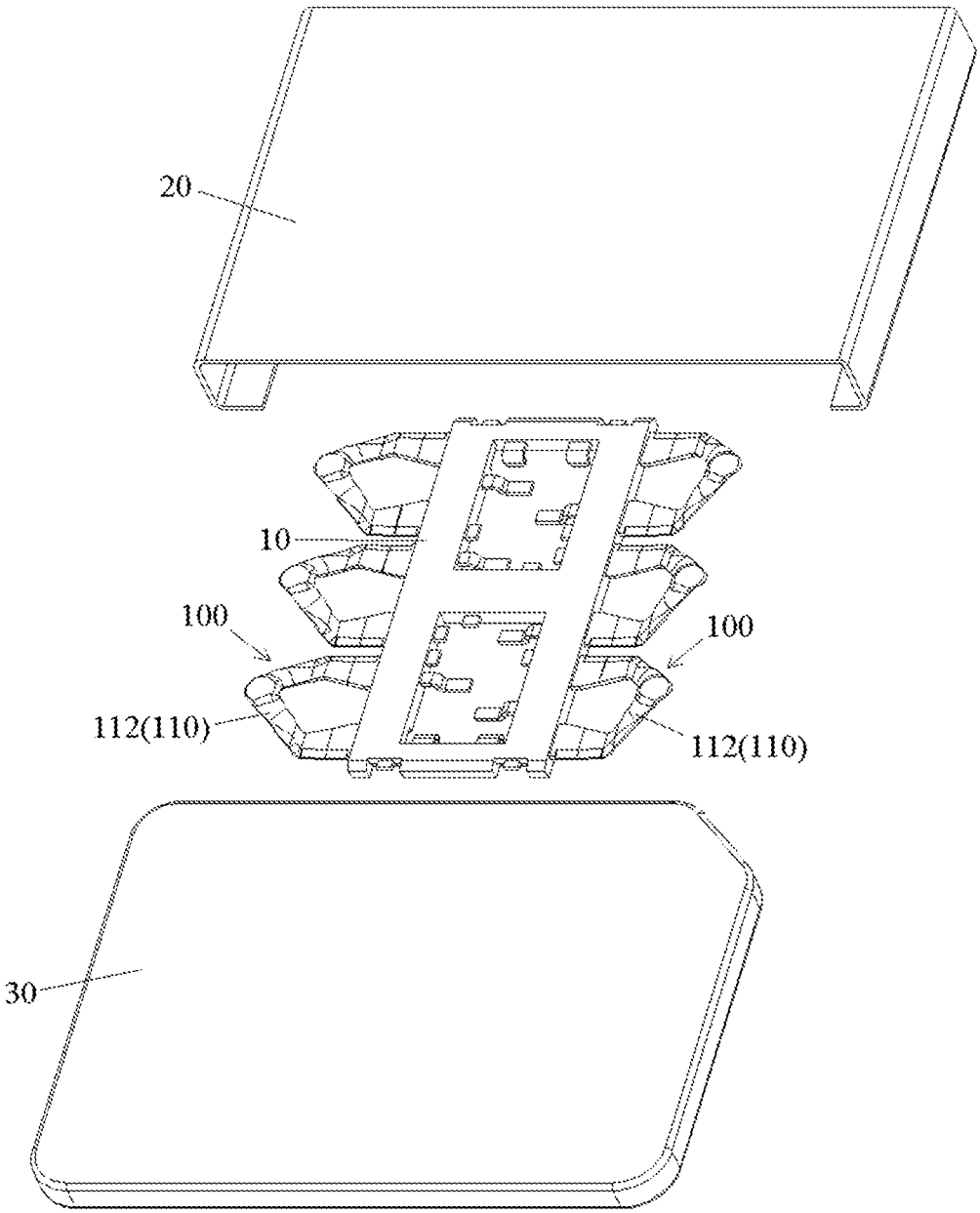
FIG. 4 is an exploded view of a card connector and a complementary electrical card.
Figure 5:
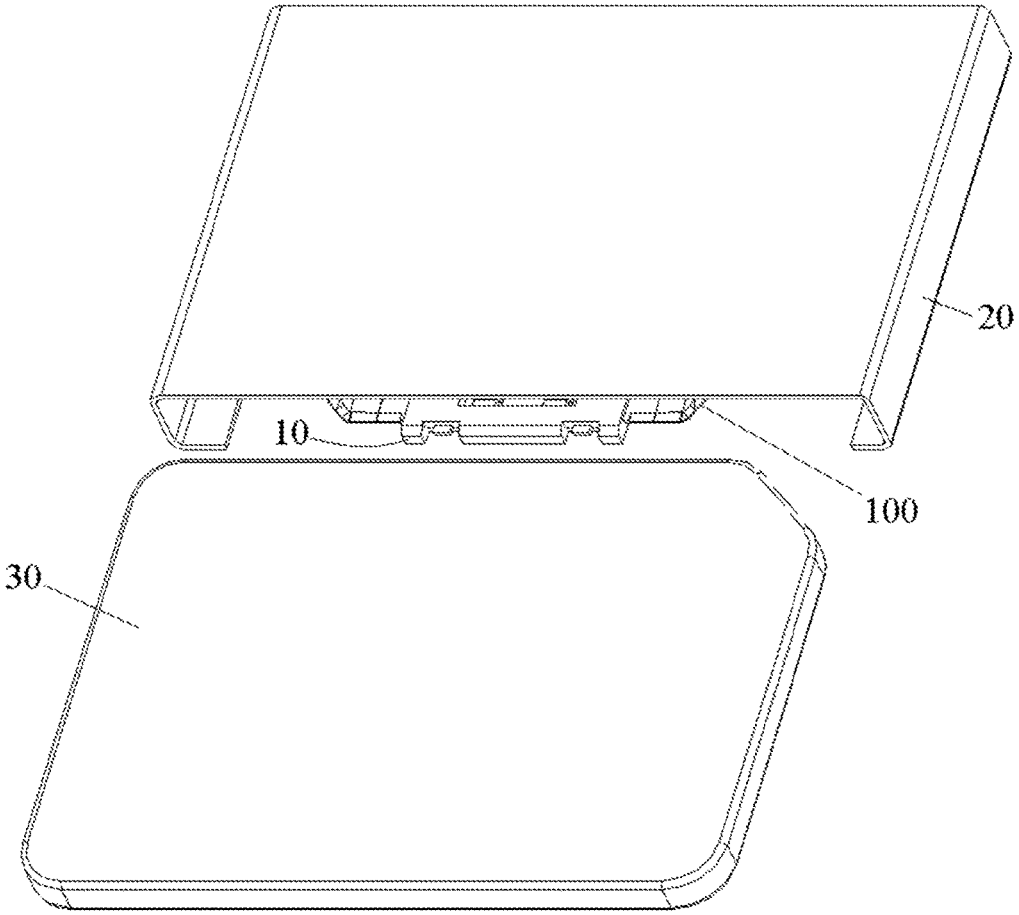
FIG. 5 is a perspective view of the assembled card connector and the complementary electrical card.

In an embodiment shown in FIGS. 1-5, the convex surfaces on the first and second guide arm portions 112,122 act as guiding surfaces for guiding an electrical card 30 or a card tray (not shown) to smoothly slide over the elastic arms 110, 120. During insertion of the electrical card 30 into the card connector, as shown in FIGS. 4-5, the electrical card 30 firstly contacts the first guide arm portion 112, and then gradually presses the first elastic arm 110 of the contact 100 downward. The card 30 then slides along the convex surface of the first guide arm portion 112 towards the contacting portion 13 to electrically contact the contacting portion 130.

The convex surfaces of the guide arm portions 112, 122 are smooth surfaces without sharp edges, bowing outward continuously across the entire outer surface and extending along the length of the guide arm portions 112,122 to the contacting portion 130. Thereby, the electrical card 30 or the card tray can smoothly slide over the contact 100 under the guidance of the convex surface. Consequently, since convex surface is smooth, it protects the electrical card 30 or the card tray from being scratched or worn by the contacts 100, and/or protects the contacts 100 from being scratched or worn by the electrical card 30 or the card tray.

In the embodiments shown in FIGS. 1-3, the convex surface of the first guide arm portion 112 has a first ridge line 1121 and a first strengthening region 1122 positioned along the outer facing side of the first ridge line 1121. The first strengthening region 1122 gradually tapers from the contacting portion 130 toward the first fixed end arm portion 111 of the guide arm portion 112. In an embodiment, the first strengthening region 1122 is a lip extending a distance downward. In an embodiment, the first strengthening region 1122 is tapered from the contacting portion 130 to have a very small distance or becomes zero at the first fixed end arm portion 111. Similarly, the convex surface of the second guide arm portion 122 has a second ridge line 1221 and a second strengthening region 1222 positioned along an outer facing side of the second ridge line 1221. The second strengthening region 1222 gradually tapers from the contacting portion 130 toward the fixed end of the guide arm portion 122. In an embodiment, the second strengthening region 1222 is a lip extending a distance downward. In an embodiment, the second strengthening region 1222 is tapered from the contacting portion 130 to have a very small distance or becomes zero at the second fixed end arm portion 121.

Since the strengthening regions 1122, 1222 are tapered to have a very small width or become zero at the free end of the guide arm portion 112, 122, the strengthening regions 1122, 1222 do not form a lip proximate to where the strengthening regions 1122,1222 connect to the fixed end arm portions 111,121. Therefore, the strengthening regions 1122,1222 do protrude toward a circuit board (not shown) on which the card connector is mounted. In this way, the length of the guide arm portion proximate to the fixed end does not contact or hit the circuit board when the elastic arm is pressed downward during insertion of the electrical card. Thus, the tapered shape of the strengthening regions 1122, 1222 protect the circuit board from being damaged by the fixed end of the guide arm portion.

In an embodiment, in order to protect the electrical card or the card tray from being worn by the contacts 100, the contacting portion 130 has a smooth, curved outer surface. For example, the contacting portion 130 may have a smooth, spherical outer surface.

As discussed above, the first elastic arm 110 and the second elastic arm 120 have the first fixed end arm portion 111 and the second fixed end arm portion 121, respectively, fixed to the base 10 and connected to the guide arm portion 112, 122. An outer surface of the guide arm portion 112, 122 is smoothly transited to an outer surface of the fixed end arm portion 111, 121. In an embodiment, a gradual chamfer transition is formed between the outer surface of the guide arm portion 112, 122 and the outer surface of the fixed end arm portion 111, 121. For example, a gradual, rounded chamfer transition is formed between the outer surface of the guide arm portion 112, 122 and the outer surface of the fixed end arm portion 111, 121. In this way, the chamfered transition prevents any sharp edge from being formed between the outer surface of the guide arm portion 112, 122 and the outer surface of the fixed end arm portion 111, 121.

In the embodiments as shown in FIGS. 1-3, the angle α, β of each of the guide arm portions 112, 122 with respect to the card insertion direction Y-Y is approximately 20 degrees to 60 degrees.

In an embodiment, the two guide arm portions 112, 122 of each contact 100 are symmetrical in structure. Thereby, the angle α of one of the two guide arm portions 112, 122 of each contact 100 with respect to the card insertion direction Y-Y is equal to the angle β of the other of the two guide arm portions 112, 122 with respect to the card insertion direction Y-Y.

However, one of ordinary skill in the art would appreciate that the two guide arm portions 112, 122 of each contact 100 may also be asymmetrical in structure. Thereby, in an embodiment, the angle α of one of the two guide arm portions 112, 122 of each contact 100, with respect to the card insertion direction Y-Y, may be larger or less than the angle β of the other of the two guide arm portions 112, 122.

In an embodiment, the two elastic arms 110, 120 of each contact 100 have the same or substantially same length. In another embodiment, the two elastic arms 110, 120 of each contact 100 have different lengths.

In the embodiments shown in FIGS. 1-3, the fixed end arm portion 111, 121 of each elastic arm 110, 120 is substantially parallel to a top surface of the base 10. The guide arm portion 112, 122 of each elastic arm 110, 120 have an angle larger than 0 degrees and less than 90 degrees with respect to the plane of the top surface of the base 10.

In an embodiment, the angle of the guide arm portion 112, 122 of each elastic arm 110, 120 with respect to the plane of the top surface of the base 10, is approximately 30 degrees to 60 degrees. In another embodiment, the angle of the guide arm portion 112,122 with respect to the plane of the top surface of the base 10 is approximately 35 degrees to 45 degrees. In an embodiment, the two elastic arms 110, 120 of each contact 100 have a V-shaped or a U-shaped supporting portion, and the contacting portion 130 of each contact 100 is a vertex of the V-shaped or U-shaped supporting portion.

In an embodiment shown in FIGS. 1 and 2, each contact 100 has at least one terminating pad 140 connected to at least one of the elastic arms 110, 120. The contact 100 is connected to the circuit board through the terminating pad 140. In an embodiment, the terminating pad 140 is a soldering pad, although the terminating pad 140 may be other known circuit board connecting mechanisms.

As shown in FIGS. 1-3, the contacting portions 130 of the plurality of contacts 100 are arranged in two rows in the card insertion direction Y-Y.

In an embodiment shown in FIGS. 4-5, the card connector has a shield 20. The shield 20 defines a card receiving space for receiving the electrical card 30. The contacting portions 130 of the plurality of contacts 100 protrude into the card receiving space.

In the embodiments shown in FIGS. 1-3, each fixed end arm portion 111, 121 has a width gradually tapered from the base 10 toward the guide arm portion 112, 122, where the width is greater proximate to the base 10, and smaller proximate to the guide arm portion 112,122.

In an embodiment, the card connector may be adapted to match with a Subscriber Identity Module (SIM) card or any other suitable card.

Figure 6:
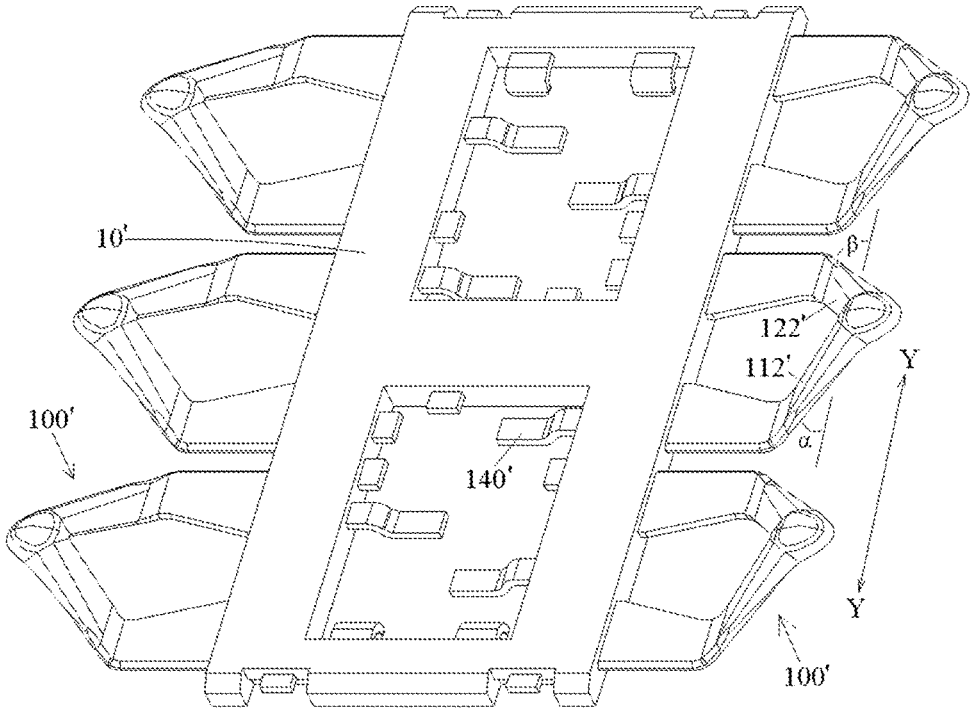
FIG. 6 is a perspective view of a second contact module having a plurality of contacts and an insulating base.
Figure 7:
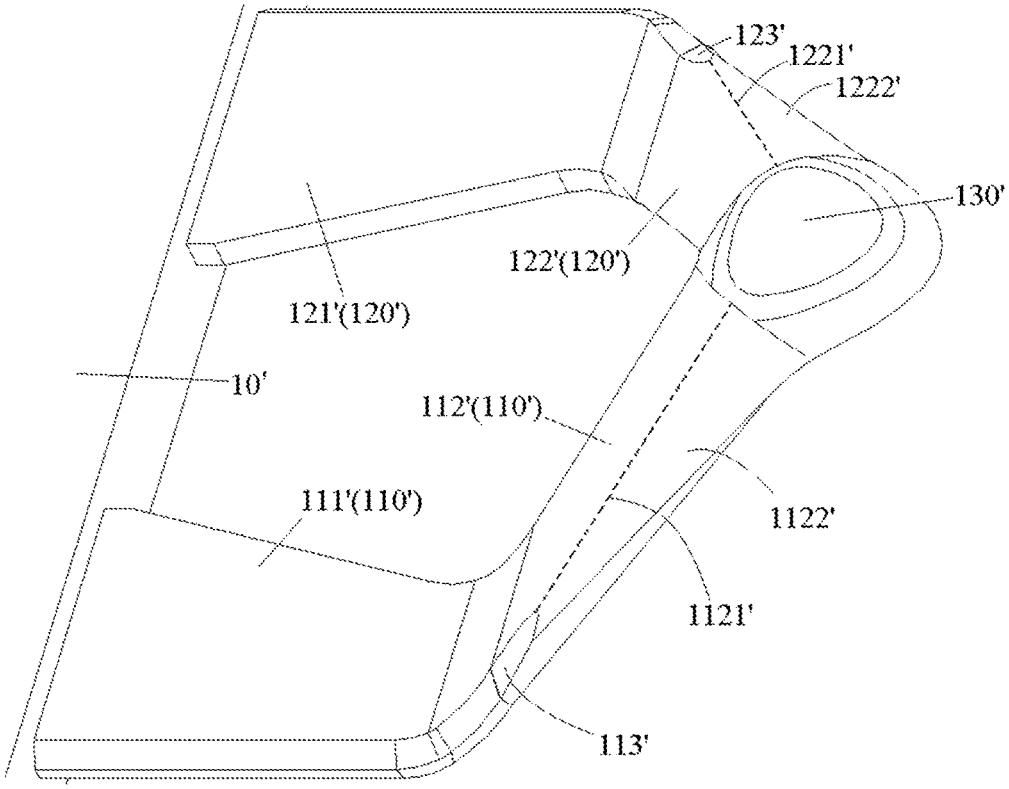
FIG. 7 is an enlarged perspective view of one of the contacts in FIG. 6.

Compared with the card connector embodiments shown in FIGS. 1-3, the only difference of the card connector embodiments shown in FIGS. 6 and 7 is that the shape of smooth, ridge-shaped convex surfaces on the first guide arm portion 112' and second guide arm portion 122' of each contact 100'. Other features of the card connector shown in FIGS. 6-7 are approximately the same as those of the card connector shown in FIGS. 1-3, where like elements have the same reference numerals. For the purposes of conciseness and brevity, discussion of like elements has been omitted.

In the embodiments shown in FIGS. 6 and 7, the smooth, ridge-shaped convex surfaces on guide arm portions 112', 122' of each contact 100' have a surface curvature radius larger than that of the convex surfaces on guide arm portions 112, 122 of each contact 100 in the embodiments shown in FIGS. 1-3. Furthermore, the fixed end side of each of the guide arm portions 112', 122' is positioned closer to the contacting portion 130' than the fixed end side of the guide arm portion 112,122 shown in FIGS. 1-3.

Figure 8:
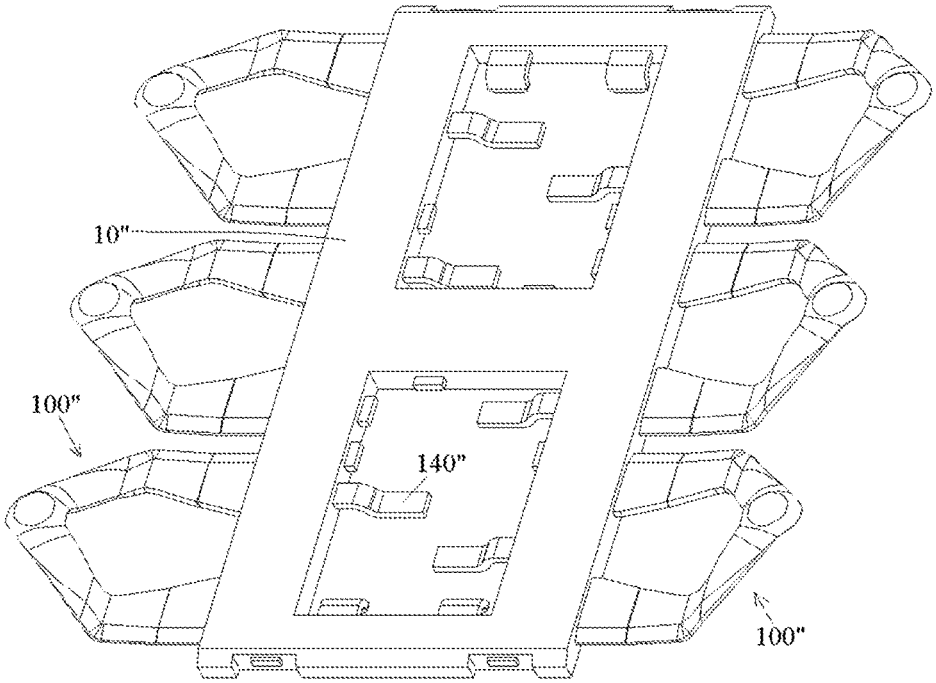
FIG. 8 is a perspective view of a third contact module having a plurality of contacts and an insulating base.
Figure 9:
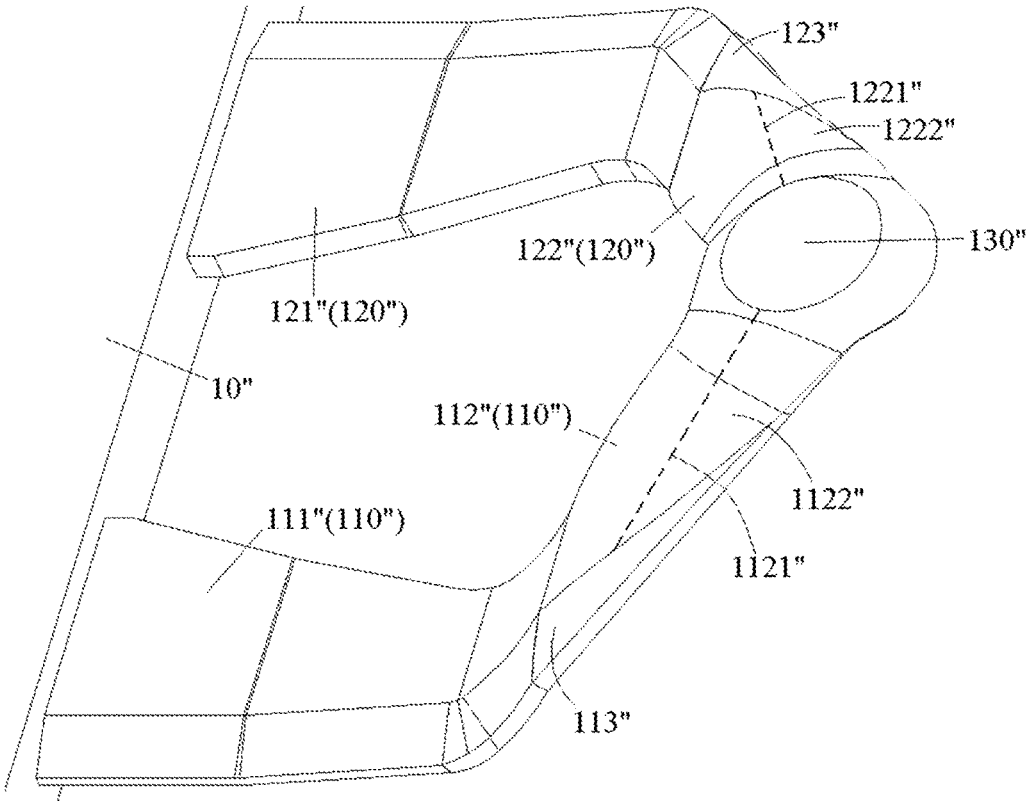
FIG. 9 is an enlarged perspective view of one of the contacts in FIG. 8.

Compared with the card connector embodiments shown in FIGS. 1-3, 6, and 7, the only difference of the card connector in the embodiments shown in FIGS. 8 and 9 is the shape of the convex surfaces on guide arm portions 112", 122" of each contact 100". Other features of the card connector in the embodiments shown in FIGS. 8 and 9 are approximately the same as those of the card connector shown in FIGS. 1-3 and 6-7. For the purpose of conciseness and brevity, discussion of like elements has been omitted herein.

In the embodiments shown in FIGS. 8 and 9, the convex surfaces on guide arm portions 112", 122" of each contact 100" have a surface curvature radius less than that of the convex surfaces on guide arm portions 112, 122 shown in FIGS. 1-3. Furthermore, the fixed end side of each of the guide arm portions 112", 122" is positioned closer to the contacting portion 130" than the guide arm portion 112' shown in FIGS. 6-7.

Those of ordinary skill in the art would appreciate that the above embodiments are intended to be illustrated, and not restrictive. For example, many modifications may be made to the above embodiments by those skilled in the art, and various features described in different embodiments may be freely combined with each other without conflicting in configuration or principle.

Although several exemplary embodiments have been shown and described, it would be appreciated by those of ordinary skill in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment," "an embodiment," "first," or "second" are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A card connector comprising:

a base; and a plurality of contacts positioned on the base, each of the contacts having a contacting portion electrically contacting an electrical card when inserted into the card connector, and having an outer facing surface, and a supporting portion having two elastic arms extending from the base and intersecting at the contacting portion, each of the elastic arms having a guide arm portion extending from the contacting portion at an angle of approximately 0 to 90 degrees with respect to a card insertion direction, having a smooth, ridge-shaped convex surface extending to the contacting portion and having a smooth transitional surface with the outer facing surface of the contacting portion.

2. The card connector according to claim 1, wherein the two guide arm portions of each contact are positioned on two opposite sides of a plane extending perpendicular to the card insertion direction and passing through the contacting portion of the contact.

3. The card connector according to claim 2, wherein the convex surface has a first ridge line having an outward facing edge; and a first strengthening region positioned along the outward facing edge, being gradually tapered from the contacting portion toward a fixed end side of the guide arm portion.

4. The card connector according to claim 3, wherein the contacting portion has a smooth, curved outer surface.

5. The card connector according to claim 3, wherein the contacting portion has a smooth, spherical outer surface.

6. The card connector according to claim 2, wherein each of the elastic arms is cantilevered, having a fixed end arm portion connected to the base on a first end, and connected to the guide arm portion on an opposite second end.

7. The card connector according to claim 6, wherein an outer surface of the guide arm portion smoothly transitions to an outer surface of the fixed end arm portion.

8. The card connector according to claim 7, wherein a gradual chamfer transition is positioned between the outer surface of the guide arm portion and the outer surface of the fixed end arm portion.

9. The card connector according to claim 8, wherein the chamfer transition is rounded.

10. The card connector according to claim 7, wherein the angle of each guide arm portion is approximately 20-60 degrees with respect to the card insertion direction.

11. The card connector according to claim 7, wherein a first angle of one of the two guide arm portions of each contact with respect to the card insertion direction is equal to a second angle of the other of the two guide arm portions with respect to the card insertion direction.

12. The card connector according to claim 7, wherein the fixed end arm portion of each elastic arm is substantially parallel to a top surface of the base.

13. The card connector according to claim 12, wherein the guide arm portion of each elastic arm has an angle of approximately 0 to 90 degrees with respect to the top surface of the base.

14. The card connector according to claim 12, wherein the guide arm portion of each elastic arm has an angle of approximately 30-60 degrees with respect to the top surface of the base.

15. The card connector according to claim 11, wherein the guide arm portion of each elastic arm has an angle of approximately 35-45 degrees with respect to the top surface of the base.

16. The card connector according to claim 7, wherein the two elastic arms of each contact intersect into a V-shape or a U-shape with the contacting portion being positioned at a vertex thereof.

17. The card connector according to claim 7, wherein each contact has at least one terminating pad connected to at least one of the elastic arms.

18. The card connector according to claim 7, wherein the two elastic arms of each contact have the same or substantially the same length.

19. The card connector according to claim 7, wherein the contacting portions of the plurality of contacts are positioned in two rows along the card insertion direction.

20. The card connector according to claim 7, wherein a card receiving space is positioned inside the card connector, and the contacting portions of the plurality of contacts protrude into the card receiving space.

21. The card connector according to claim 7, wherein each fixed end arm portion has a larger width that gradually tapers to a smaller width from the base to towards the guide arm portion .

22. The card connector according to claim 20, wherein a Subscriber Identity Module card is positioned in the card receiving space.

* * * * *